United States Patent [19]

Howell

[11] Patent Number: 4,481,713

[45] Date of Patent: Nov. 13, 1984

[54] RECIPROCATING DRAFTING PEN

[76] Inventor: David C. Howell, 333 Hook Rd., Katonah, N.Y. 10536

[21] Appl. No.: 498,847

[22] Filed: May 27, 1983

[51] Int. Cl.[3] ..... B43C 13/02

[52] U.S. Cl. ..... 33/39 B; 33/32 C; 33/35; 33/42

[58] Field of Search ..... 33/42, 32 R, 32 B, 32 C, 33/34, 35, 39 R, 39 B, 41 R, 41 F, 18 R

[56] References Cited

U.S. PATENT DOCUMENTS

| | | | |
|---|---|---|---|
| 681,574 | 8/1901 | Oettinger | 120/109.5 |
| 715,007 | 12/1902 | Bossart-Baechi | 120/109.5 |
| 1,314,879 | 9/1919 | Lewis | 120/109.5 |
| 2,036,716 | 4/1936 | Nelson | 120/109.5 |
| 2,041,022 | 5/1936 | Rassmussen | 33/42 |
| 2,467,083 | 4/1949 | Francis, Jr. | 172/26 |
| 2,963,337 | 12/1960 | Spalek | 346/140 |
| 3,297,003 | 1/1967 | Benson | 120/45.6 |
| 3,384,965 | 5/1968 | Sicking | 33/18 R |
| 3,440,861 | 4/1969 | Oehlerking | 72/430 |
| 3,564,712 | 2/1971 | Davis | 30/164.9 |
| 3,613,248 | 10/1971 | McInnis | 33/18 R |
| 3,997,972 | 12/1976 | Jaunarajs | 33/18 R |
| 4,037,283 | 7/1977 | Moisiuk | 15/4 |
| 4,157,552 | 6/1979 | Nakajima | 33/18 R |
| 4,211,012 | 7/1980 | Alles et al. | 33/18 R |

FOREIGN PATENT DOCUMENTS

| | | | |
|---|---|---|---|
| 730747 | 8/1932 | France | 33/41 F |
| 875060 | 9/1942 | France | 33/18 R |
| WO83/00845 | 3/1983 | PCT Int'l Appl. | |
| 7065 | 6/1893 | Switzerland | 33/35 |

*Primary Examiner*—Willis Little

*Attorney, Agent, or Firm*—Curtis, Morris & Safford, P.C.

[57] ABSTRACT

A reciprocating drafting pen device is provided for automatically lifting a technical pen and replacing it onto drafting paper while the pen is drawn transversely across the paper, for stippling, or for the drawing of various other interrupted lines. The apparatus includes a barrel, a piston mechanism disposed within the barrel and longitudinally movable therein, a technical pen held by the piston mechanism and movable therewith, including an ink reservoir and a pen nib extending out one end of the barrel. A guide foot is adjustably attached to one end of the barrel for maintaining a desired standoff between the barrel and the drafting paper to be inked. An electromechanical drive mechanism moves the piston mechanism longitudinally, and thereby also moves the drafting pen such that the nib is brought alternately into contact and out of contact with the drafting paper. Favorably, one or more adjustable piston stops can be provided for to facilitate removal of the technical pen from the piston mechanism. The drive mechanism can include a solenoid, a piezoelectric drive mechanism, or a motor-driven cam.

14 Claims, 18 Drawing Figures

RECIPROCATING DRAFTING PEN

This invention relates to hand-held ink marking devices, and is more particularly directed to drafting instruments, such as technical pens and the like for use in illustrating and in drafting mechanical drawings.

In the art of the mechanical drawing, and in other related arts, ink is applied to the draft paper with a technical pen. Where cross hatching, shading, dot lines, dash lines, stippling or any line other than a solid line is desired, it is necessary to lift the technical pen manually from the drawing surface and replace the pen intermittently. If there is any more than a minimal amount of cross hatching, dotting, or other type of intermittent lining to be done, the process becomes tiresome and must be done slowly. Consequently, if large areas of a drawing to be inked include a significant amount of such intermittent lining, the quality of the work can suffer.

Accordingly, it is an object of this invention to provide a technical pen device which automatically lifts and drops the nib of a technical pen as it is run across a drafting medium to produce an intermittent line, which line can be applied relatively rapidly and without tiring the draftsman.

It is another object of this invention to provide such a technical pen device which can be hand held and which is easily portable.

It is still another object of this invention to provide such a technical pen device in which a technical pen, including a pen nib and an ink reservoir, are driven reciprocally by means of an electromechanical device such that the nib of the pen is regularly lifted from and then brought into contact with the drafting medium.

It is yet a further object of this invention to provide such a technical pen device in which current or voltage supplied to the electromechanical device is regulated to control both the length of the time that the nib is on the drafting medium and also the frequency at which it is alternately lifted from and applied to the drafting medium, thereby affording the user a vast repertoire of intermittent lines, including dots, dashes, chain lines, and many other types of lines.

In accordance with an object of this invention, reciprocating drafting pen apparatus are provided for drawing interrupted lines. Such apparatus can comprise a cylindrical housing, or barrel, with a cylindrical piston disposed within the barrel and longitudinally movable with respect to it. A drafting pen or technical pen, including an ink reservoir and a pen nib, is held onto the piston such that the pen nib extends out one end of the barrel for applying ink to the drafting medium when the nib is in contact with it. A guide foot, which in one favorable embodiment can be a J-shaped member, is adjustably connected to the pen-nib end of the barrel and serves to maintain a desired standoff between the barrel and the drafting medium when the drafting pen apparatus is in use. Electromechanical drive means within the barrel move the piston longitudinally in response to an electric drive signal applied to it so that the piston, and with it the pen are reciprocated. Accordingly, the nib is alternately brought into contact and out of contact with the medium. The guide foot can also be a straight member, a knobbed-end rod, or other suitable shape adapted to the type of drawing to be done Adjustable piston stops are preferably included to limit the stroke length of the piston, and their positions in the barrel can be selectively set to achieve optimum results.

In one favorable embodiment, the drive means can include a solenoid and plunger for actuating the piston. In another favorable embodiment, the drive means can include a piezoelectric leaf having one end fixed relative to the barrel, and a free end biasing the piston. In this embodiment, voltage pulses applied to the piezoelectric leaf bend the latter so as to reciprocate the drafting pen.

In several preferred embodiments, the electric drive signal supply means can be an external supply coupled by means of a cable to the drafting pen apparatus. In other favorable embodiments, the drafting pen apparatus can be completely self-contained, with dry cells in the barrel supplying electricity to actuate the electromechanical drive means.

The above combination of features, including the barrel, the electro-mechanically reciprocating nib, and the guide foot, provide many advantages not available using conventional techniques. The guide foot serves to keep the nib off the surface of the drafting medium. Because the guide foot is adjustable, the drafting pen apparatus of this invention can be used at many different angles according to the particular needs and desires of the individual draftsman. Of course, the guide foot also provides the draftsman with an accurate indication of where the pen nib is going to touch down to apply ink to the surface of the drafting medium.

Moreover, the drafting pen apparatus of this invention is constructed to operate with any of a variety of technical pens, so that the color of ink and the breath of the line can be changed rapidly, simply by replacing the reservoir, nib, or both of the technical pen held within the piston.

The above, and many further objects, features, and advantages of this invention will be more fully appreciated from the ensuing description of several preferred embodiments, which is to be considered in connection with the accompanying drawings, in which FIG. 1 shows generally a reciprocating drafting pen apparatus according to an embodiment of this invention, including also a drive current supply;

FIG. 1A is an elevational view of the control panel of the drive current supply;

FIGS. 2, 3, and 4 illustrate the operation of the reciprocating pen apparatus of FIG. 1;

FIGS. 5, 6, and 7 show intermittent lines of the type which can be drawn with the reciprocating pen device of this invention;

Figure 1:
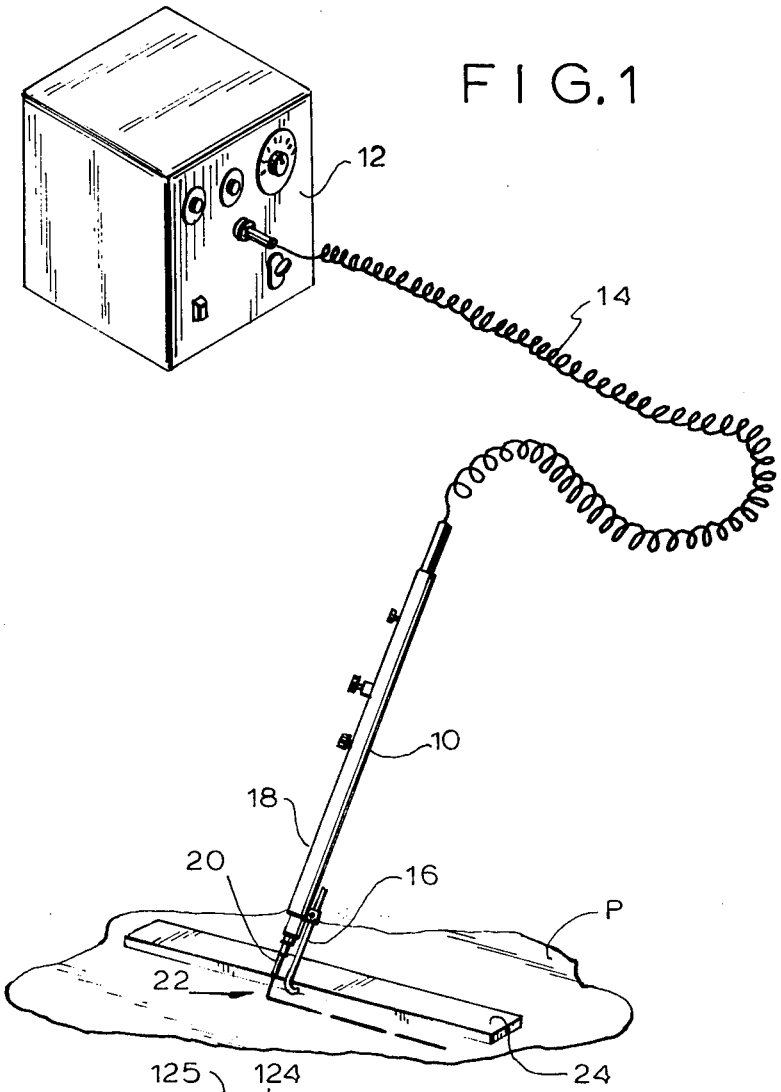
Figure 1A:
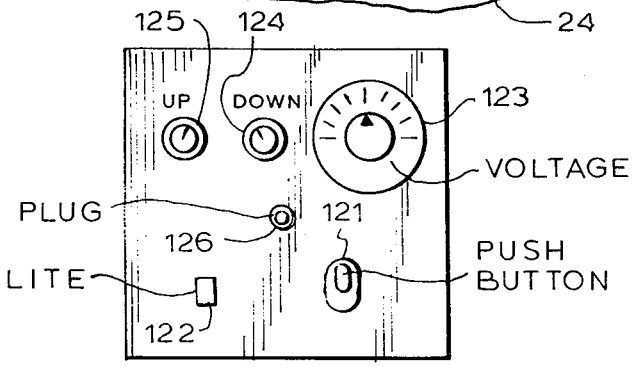

With reference to the drawings, and initially to FIGS. 1 and 1A thereof, one embodiment of the reciprocating pen apparatus of this invention includes a reciprocating pen device 10 and an external pulse power supply 12 connected thereto by means of a cord 14.

As shown in FIG. 1A, the control panel of the pulse power supply includes an on/off switch 121, a pilot lamp 122, a voltage control knob 123, which can be coupled to a potentiometer or variable transformer, and timer controls 124 and 125, for respectively controlling the periods for which the pulse power signal is high and low. These controls 124 and 125, in effect, control the time that the pen contained within the device 10 is lifted off drafting paper P and is returned into contact therewith. A jack 126 in the control panel serves as a receptacle for plugging in one end of the cord 14.

As shown in FIG. 1, the pen device 10 has a guide foot 16 adjustably mounted on one end of a cylindrical pen barrel 18. This guide foot 16 is J-shaped with the curved end disposed outwardly for conforming with the finger of a draftsman. A technical pen 20 is disposed at least partially within the barrel 18 and has a pen nib 22 protruding from the lower end of the barrel 18.

As shown in FIG. 1, the guide foot 16 can be held against a straight edge 24 while the pen device 10 is moved laterally across a sheet of drafting paper P or other drafting medium. The guide foot 16 establishes a standoff distance between the paper P and the barrel 18 to conform with the draftsman's preference, so that the intermittent line that is drawn with the pen device 10 is reliable and uniform.

Figure 2:
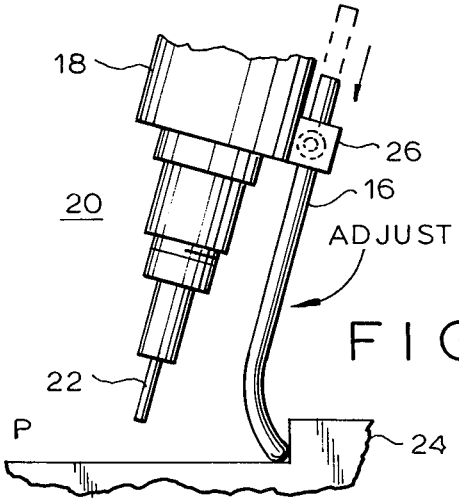

As shown in FIG. 2, the shank of the J-shaped guide foot is releasably held in a mounting device 26 at the lower end of the barrel 18. Accordingly, the standoff provided by the guide foot 16 can be adjusted by moving the guide foot 16 longitudinally with respect to the mounting 26. When the position of the guide foot corresponds to the desired standoff, the guide foot 16 can be secured in the mounting 26, by means of a set screw or the like.

Figure 5:
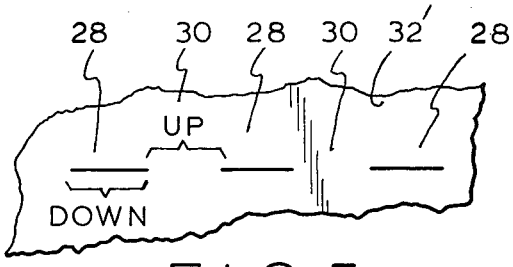
Figure 3:
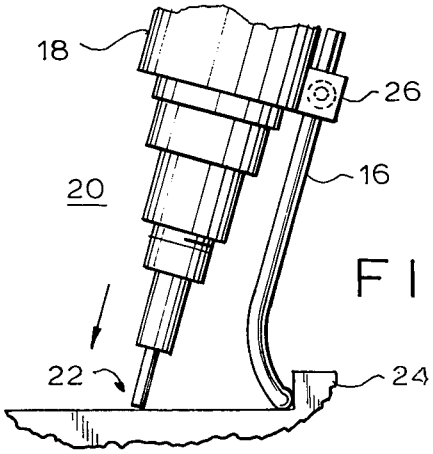
Figure 4:
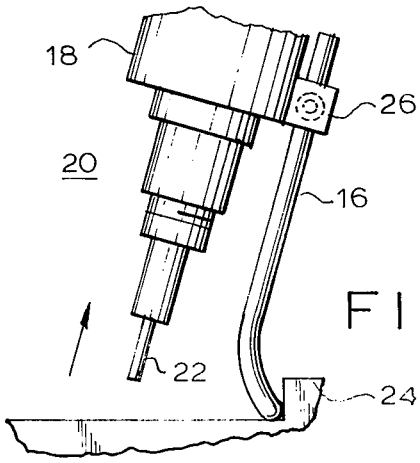

If the pen device 10 is moved laterally while the guide foot 16 is kept against the straight edge 24, the technical pen 20 within the barrel 18 will be reciprocated downwardly and upwardly, respectively, as shown in FIGS. 3 and 4. Following a down stroke (FIG. 3) the pen nib 22 is maintained in contact with the drafting paper P, thereby yeilding a solid line segment 28 as shown in FIG. 5. Subsequently, after an up stroke (FIG. 4), the nib 22 is held away from the drafting paper P, thereby yielding a blank space 30 between the line segment 28, as is also shown in FIG. 5. Accordingly, if the apparatus 10 is moved at a steady rate across the paper P while the technical pen 20 is stroked alternately upwards and downwards, a broken line will result as is shown in FIG. 5.

Figure 6:
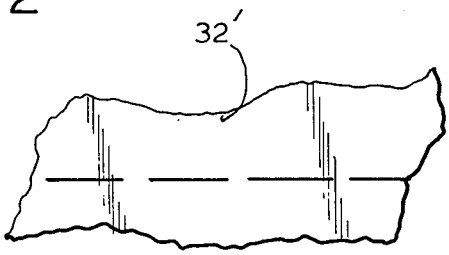
Figure 7:
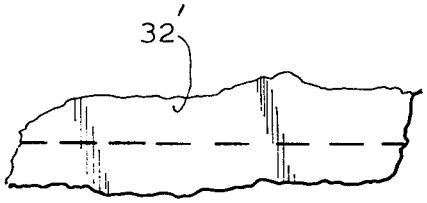

As shown illustratively in FIGS. 6 and 7, respectively, a dashed line 32 can be obtained if the down stroke period is longer than the upstroke period, and a series of closely-spaced short segments 32' can be obtained by keeping the upstroke period and downstroke period both relatively short.

While not specifically shown, many other desired types of broken or intermittent lines can be drawn using the device of this invention; for example, dot lines and chain lines can be obtained by varying the down periods and up periods in appropriate fashions.

Figure 8:
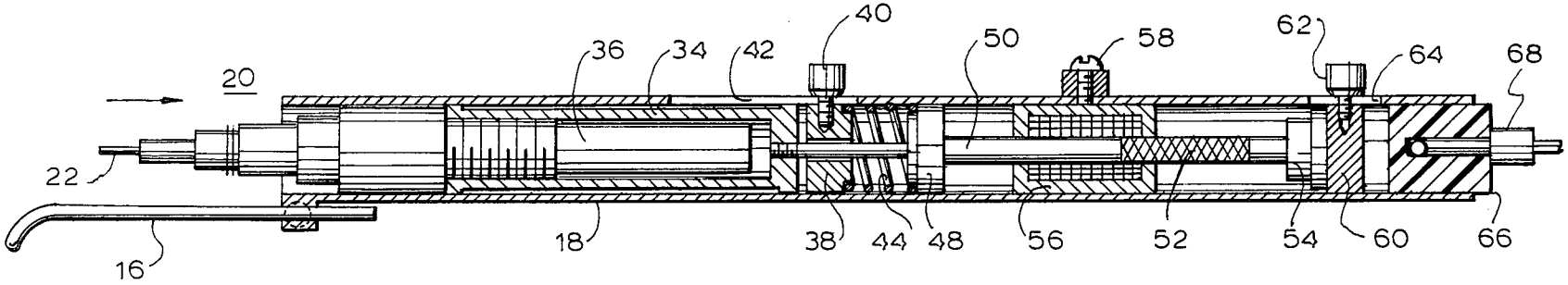
FIGS. 8 and 9 are cross sectional views of the reciprocating pen apparatus of one embodiment of this invention.
Figure 9:
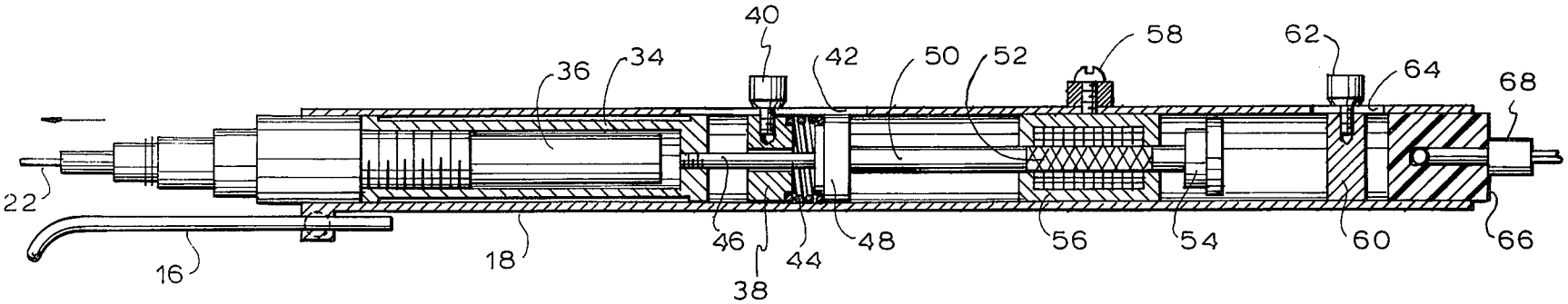
Figure 10:
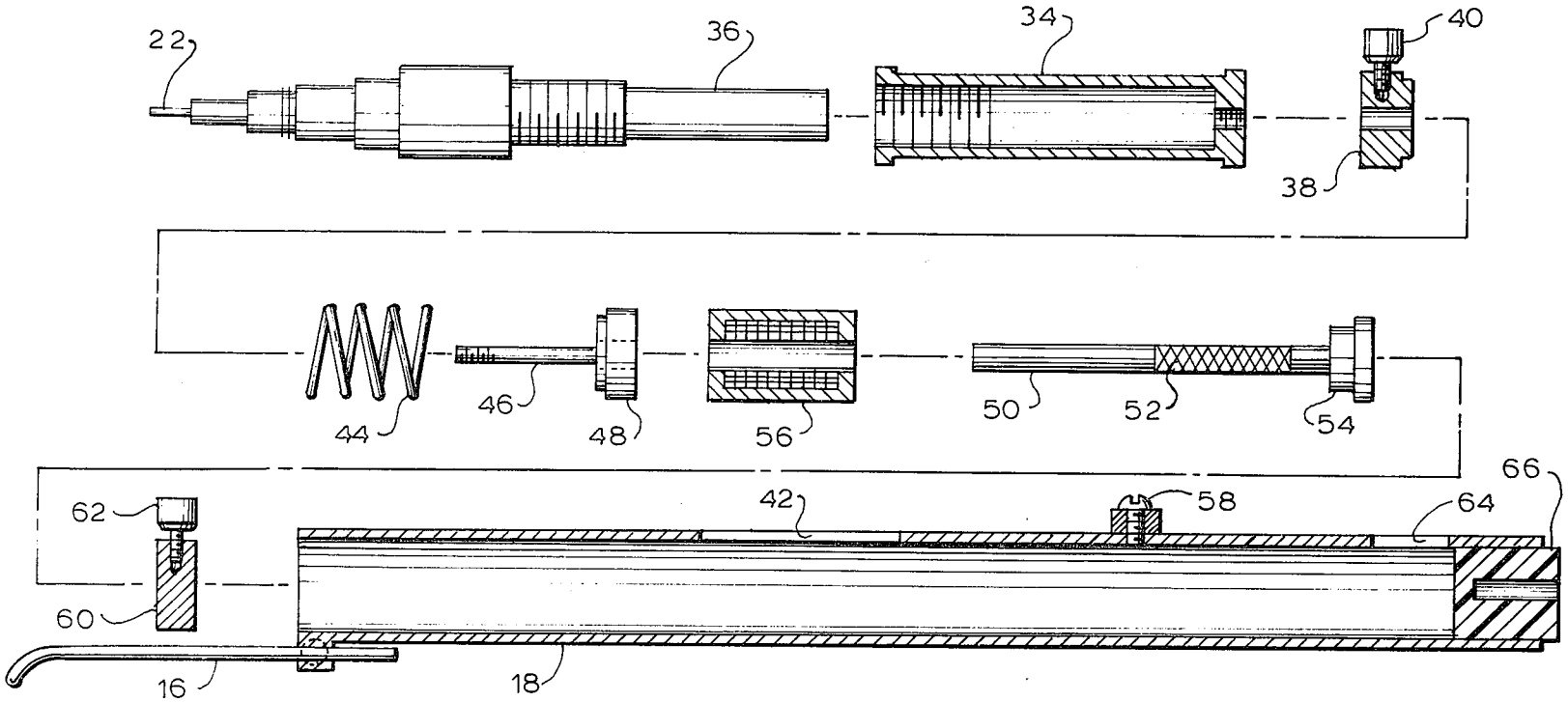
FIG. 10 is an exploded view of the reciprocating pen apparatus of FIGS. 8 and 9.

The first embodiment of the reciprocating pen device of this invention is shown in cross section in FIGS. 8 and 9, and in exploded form in FIG. 10. Within the generally cylindrical barrel 18 of this embodiment there is a reciprocating, electro-mechanically driven piston arrangement for moving the technical pen 20. This piston device is formed generally as described below.

A generally cylindrical pen holder 34 constitutes a front end of the piston arrangement and is threadably connected to an ink reservoir 36 forming a part of the technical pen 20 together with the nib 22. The nib 22 extends out the front or distal end of the barrel 18. Behind the holder 34 is an adjustable piston stop 38 which can be formed as a machined or molded plug secured by a hold-down screw 40 extending through a longitudinal slot 42 in the barrel 18. The slot 42 need not be straight, but can, e.g., be helical, so long as it is elongated, with a longitudinal component. A helical spring 44 has one end biasing against the stop 38. A piston dasher 46 threadably connected to the rear end of the pen holder 34 has a head 48 biased against the other end of the spring 44. A piston shaft 50, in which a central portion 52 thereof is formed of ferromagnetic material and serves as a plunger, has a piston head 54 at the rear end thereof, and extends through a solenoid 56. When the solenoid 56 is energized, the plunger portion 52 is drawin in and urges the dasher head 48 forward. The solenoid 56 is held in place within the barrel 18 by means of a hold-down screw 58 longitudinally fixed on the barrel 18.

A rear piston stop 60 is disposed behind the piston head 54 and establishes the rearmost limit of its piston stroke. This stop 60 is maintained in a selected longitudinal location by means of a hold-down screw 62 extending through a longitudinal slot 64 in the barrel 18. Finally, a jack 66 is mounted at the rear or proximal end of the barrel 18; a plug 68 on the cord 14 from the supply 12 is plugged into this jack 66.

Although not shown, the jack 66 is connected by wire leads to the solenoid 56.

Whenever the drive signal from the pulse power supply 12 is low, the solenoid 56 remains unenergized, and the spring 44 biases the piston arrangement, and thus the pen nib 22, proximally, and thus away from the paper, as shown in FIG. 8. However, when the drive signal from the supply 12 is high, current flows through the solenoid 56 thereby driving the piston arrangement forward to the limit of its stroke as established by the position of the front piston stop 38. This brings the pen nib 22 into contact with the drafting medium, as shown in FIG. 9.

Figure 11:
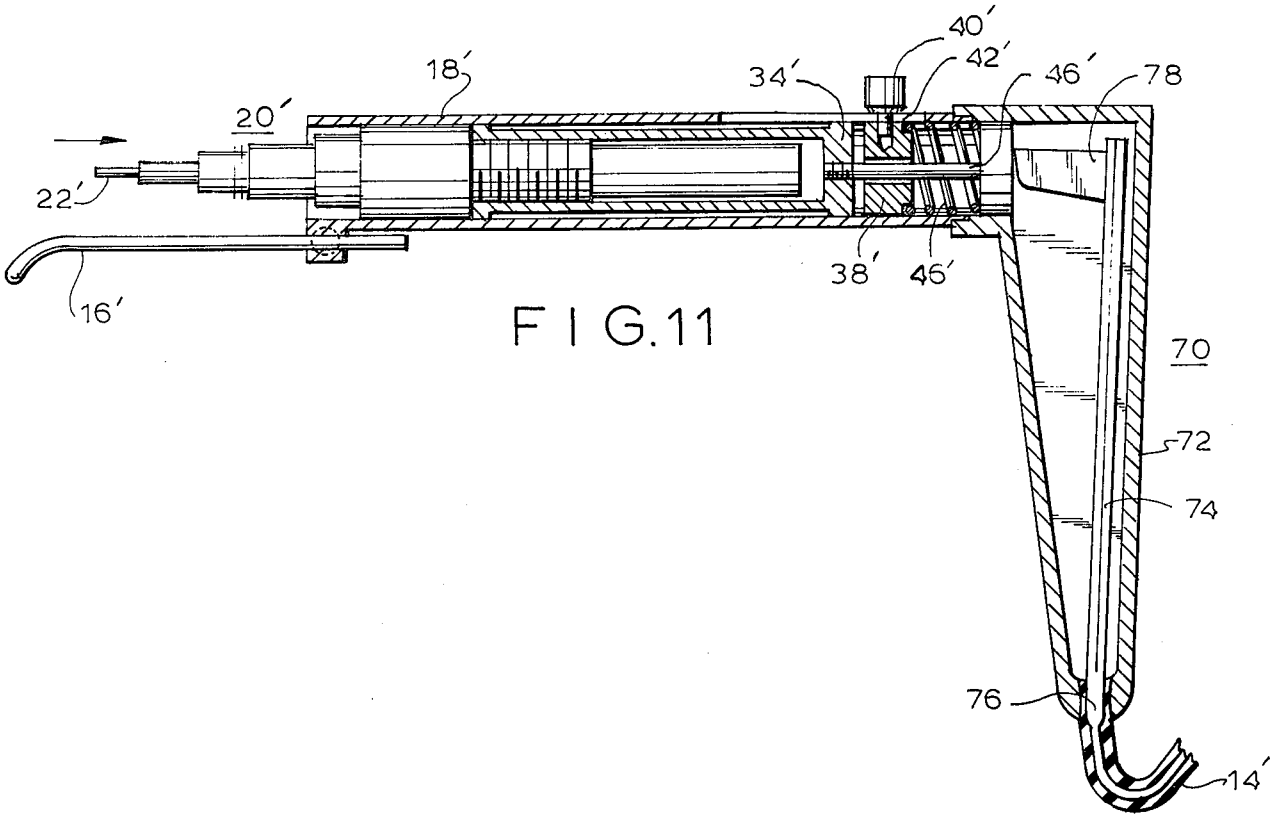
FIGS. 11 and 12 illustrate a reciprocating pen apparatus according to another embodiment of this invention.
Figures 12, 17:
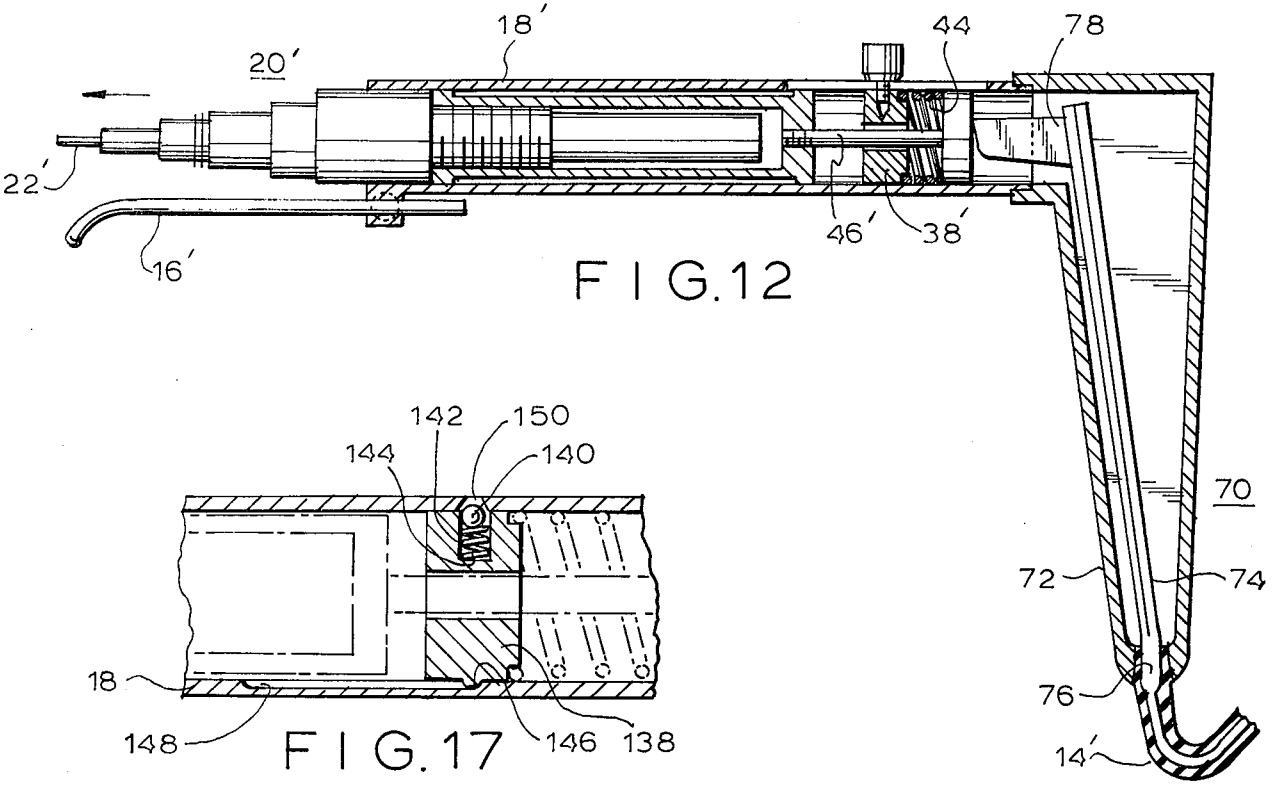
FIG. 17 is a cross section of a portion of another pen according to this invention.

FIGS. 11 and 12 illustrate another embodiment of this invention, in which also shown in FIGS. 8 to 10 elements are identified with the same reference characters, but primed, and for which a detailed description will be omitted. In this embodiment, a piezoelectric drive mechanism 70 imparts a stroke to the technical pen 20' disposed within the generally cylindrical barrel 18'. The term piezoelectric drive leaf is here used to mean any type of mechanism that bends when an electrical potential is applied to it. This of course, includes known piezoelectric devices, such as bimorph leaves and piezo ceramic benders, as well as many other piezoelectric devices. In this device 10', the drive piston includes a pen holder 34', a piston shaft 46', and a head 48' thereof, with a spring 44' biasing the piston head 48' rearwardly relative to an adjustable piston stop 38'.

The piezoelectric drive mechanism 70 includes a housing 72 attached to the proximal end of the barrel 18'. A piezoelectric leaf 74 has one end 76 affixed to the housing. A finger 78 mounted on the free end of the leaf 74 pushes against the piston head 48'. Here, leads of the cord 14' are coupled from a drive signal voltage source to the piezoelectric leaf 74 to apply a potential thereacross.

When the applied drive signal voltage is low, the leaf 74 is bent proximally (FIG. 11) so that the pen nib 22' is retracted. However, when the applied drive signal voltage is high, the leaf 74 bends forward (FIG. 12) extending the nib 22' distally against the drafting medium P.

One advantage of the piezoelectric drive of this embodiment is that considerably less power is required than in the solenoid-driven embodiment. Thus, this embodiment can be constructed with an internal power supply, for example, driven by small dry cells, so that the pen can be made completely portable and self contained.

Figure 13:
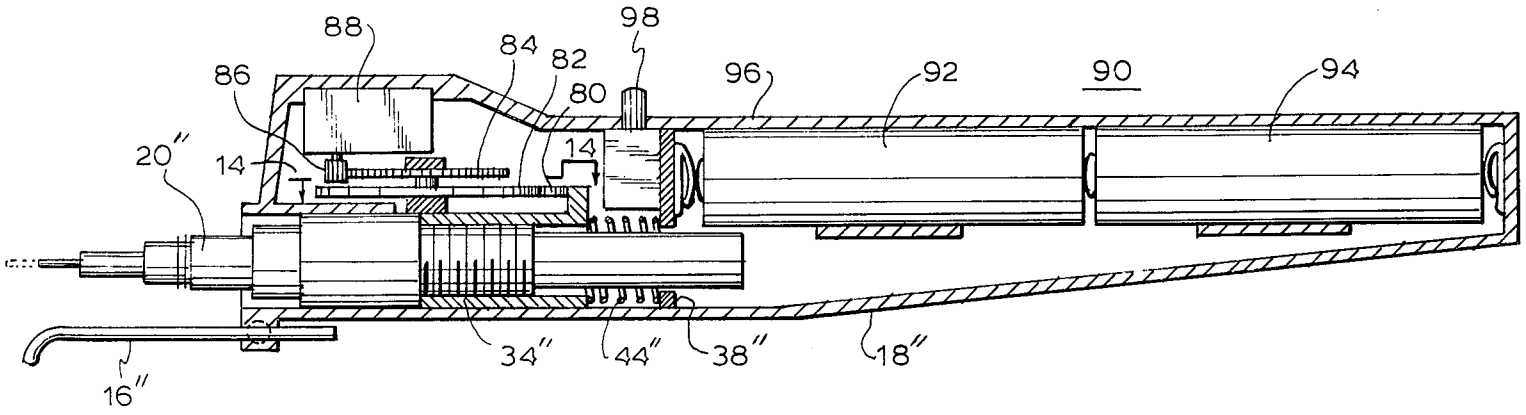
FIGS. 13 and 14 are a longitudinal cross section and a partial plan view, respectively, of a reciprocating pen according to another embodiment of this invention.
Figure 14:
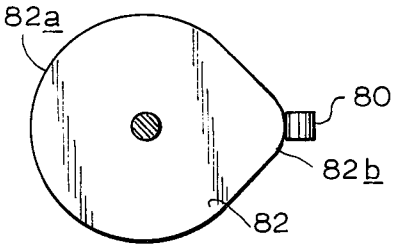

FIGS. 13 and 14 illustrate yet another embodiment of this invention, in which elements shown in either of the first two embodiments are identified with the same reference characters, but double primed.

In this embodiment, the barrel 18'' is enlarged somewhat to accomodate an electric-motor driven displacing device and a pair of dry cells, so that the pen device 10'' is completely self-contained.

Here, the technical pen 20'' is held in a pen holder 34'', the latter being formed as a bushing slidably mounted within the barrel 18''. The spring 44'' biases the bushing 34'' distally away from a trasverse wall 38''.

The drive mechanism for imparting a stroke to the bushing 34'' includes a cam follower 80 extending radially from the proximal end of the bushing 34'' and engaging a cam surface of a cam wheel 82. The latter is turned by a spur gear 84, engaged by a pinion 86 that is a driven by a small DC motor 88.

A battery compartment 90 in the proximal end of the barrel 18'' contains a pair of AA dry cells 92 and 94, which supply drive current to the motor 88. A switch 96 having a switch button 98 extending outwardly through the barrel 18'' controls the actuation of the motor 88.

Figure 15:
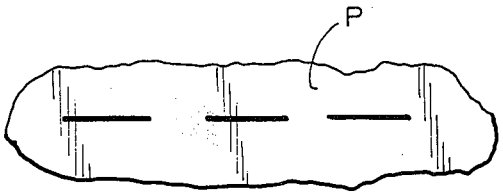
FIG. 15 shows an intermittent line as drawn with the apparatus of FIGS. 13 and 14.

Normally, the follower 80 engages a circular portion **82*a* of the cam wheel 82, and the pen 20'' is distally disposed within the barrel 18''. Thus, when the switch 96 is not actuated, the device of this embodiment can be used as a standard technical pen. However, when the button 98 is depressed, the cam wheel 82 rotates. Whenever a protuberance 82*b* thereon engages the follower 80, the pen 20'' is moved proximally, and is lifted off the drafting paper P. Thus, when the button 98 is depressed while the device is moved transversely, a dashed line, such as that shown in FIG. 15**, will result.

The device of this embodiment is self-contained, and can be held comfortably in the hand. It is portable, and not cumbersome to hold. Therefore, the reciprocating pen device of this embodiment is particularly suitable for a draftsman who must prepare or amend drawings out of the office.

Figure 16:
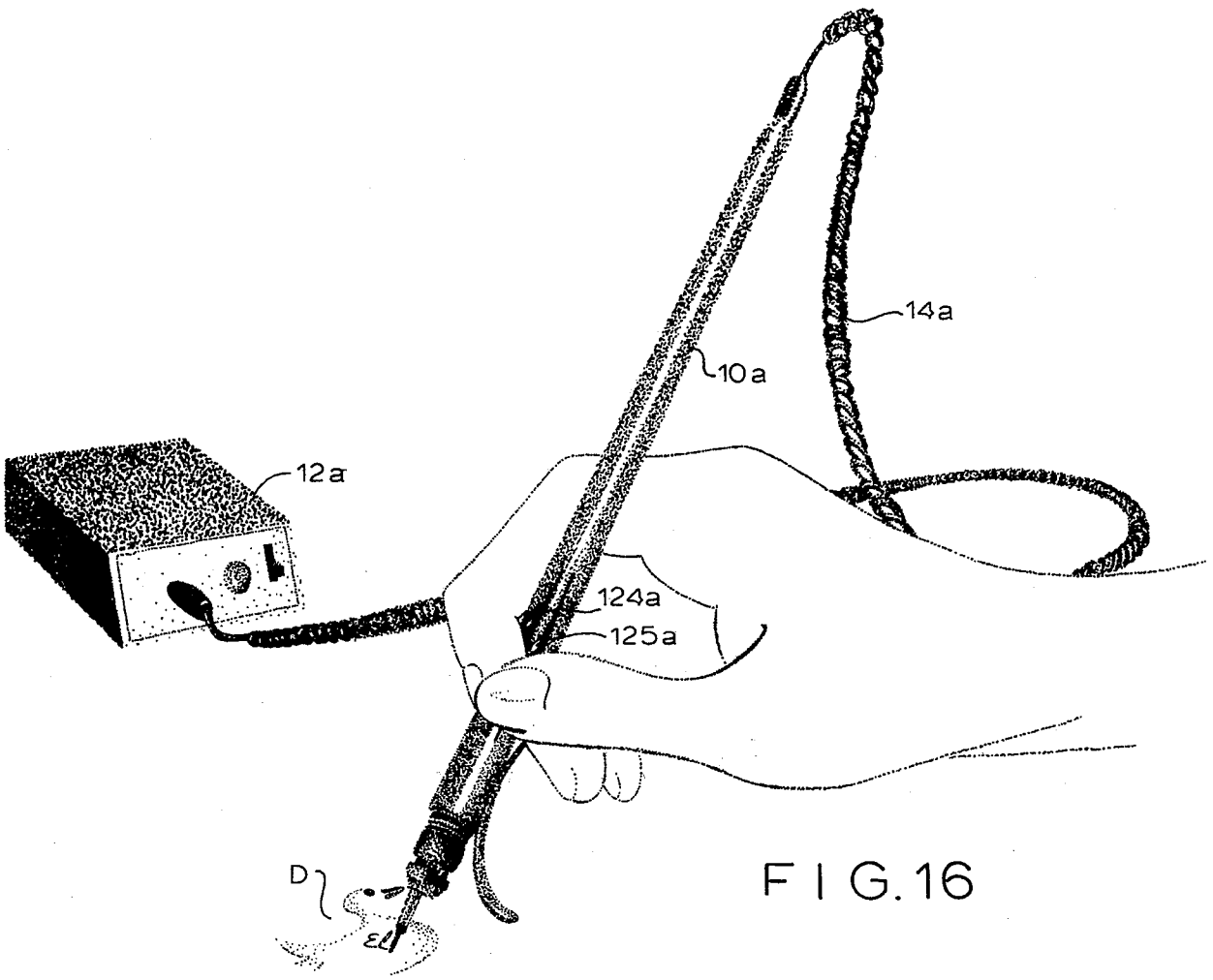
FIG. 16 is an illustration of another embodiment of the pen of this invention, here itself drawn with a pen according to this invention to show the stippling effect possible with pens of this invention.

FIG. 16 shows yet another embodiment of this invention, here with a reciprocating pen device **10*a* held in a draftsman's or artist's hand and a pulse power supply 12*a* connected thereto by a cord 14*a*. In this embodiment, the controls 124*a* and 125*a* for controlling stroke duration are located directly on the pen barrel to facilitate fingertip control. This particular drawing is of special interest as it not only shows a pen device 10*a* being used for stippling a drawing D, but FIG. 16** itself was drawn using a technical pen device of this invention set into a stippling mode. As is apparent, the quality of the stippling is excellent, yet the drawing can be done with significantly less effort and fatigue than is possible using conventional techniques.

In the illustrated embodiments of this invention, especially in that shown in FIGS. 8–10, the changing of the technical pen can be facilitated by moving the front piston stop 38 to its extreme forward position Then the pen 20, 20', or 20'' protrudes sufficiently so that the pen, including the ink reservoir 36, 36', or 36'' can be unscrewed from its associated holder 34, 34', or 34''. In accordance with this feature, the forward stop 38 can be formed with a ball and socket detent arrangement (FIG. 17), in which a ball 140 and a spring 142 are situated in a bore 144 in the stop member 138. A radial projection 146 on the member 138 is slidably situated in a longitudinal guide recess 148 on the inner surface of the barrel 18, and the detent ball 140 snaps into a corresponding recess 150 on the barrel 18 to hold the stop member 138 in its rearward position for a drawing mode. If it is desired to change nibs or reservoirs, the detent 140, 150 can be easily released, and the stop member 138 urged forward to the front of the guide recess 148 so that the pen nib and reservoir can be removed from the piston pen holder.

The term "technical pen" as used hereinabove is intended to cover all possible equivalents to the drafting instrument shown above, including felt tip markers, which, of course, can be of any convenient size or ink color. In the case of a felt tip marker, the "nib" would be the felt tip which applies the ink to paper.

Although the present invention has been described with reference to particular preferred embodiments, it is to be understood that the invention is not limited to those embodiments, but that many modifications and variations thereof will be apparant to those of ordinary skill, without departing from the scope and spirit of this invention, as defined in the appended claims.

What is claimed is:

1. Drafting pen apparatus suitable for stippling or drawing interrupted lines comprising a barrel; piston means disposed within said barrel and longitudinally movable therein over a stroke length; a drawing pen device attached to said piston means and movable therewith having an ink reservoir and a pen nib extending out one end of said barrel for applying ink to a medium when the nib is in contact therewith; a guide foot at said one end of the barrel, extending generally axially relative to the barrel, and adjustably connected thereto for maintaining a desired standoff of said one end the barrel from the surface of said medium; and electromechanical drive means for longitudinally moving said piston means, and with it said drawing pen device, such that said nib is brought into contact and out of contact with said medium.

2. Drafting pen apparatus according to claim 1, further comprising adjustable piston stop means for selectively limiting the stroke length of said piston means.

3. Drafting pen apparatus according to claim 1, wherein said drive means includes a solenoid disposed within said barrel, a plunger mounted on said piston means to drive the same when said solenoid is energized, and electric drive signal generator means for supplying a drive signal to said solenoid.

4. Drafting pen apparatus according to claim 1, wherein said guide foot includes a J-shaped member adapted to conform to a finger of a draftsman using the apparatus, and having its shank portion adjustably connected to the barrel.

5. Drafting pen apparatus according to claim 1, wherein said drive means includes an electrically actuated driver for moving said piston, and a drive current supply for furnishing drive current to said driver, said supply including adjusting means for adjusting the duration of the piston stroke and for adjusting the period of contact of the nib with said medium such that a draftsman using the apparatus can adjust the line segment length and the ratio of line to space in the resulting interrupted line.

6. Drafting pen apparatus suitable for stippling or drawing interrupted lines comprising a barrel; piston means disposed within said barrel and longitudinally movable therein over a stroke length; adjustable piston stop means for selectively limiting the stroke length of said piston means; a drawing pen device attached to said piston means and movable therewith having an ink reservoir and a pen nib extending out one end of said barrel for applying ink to a medium when the nib is in contact therewith; a guide foot at said one end of the barrel and adjustably connected thereto for maintaining a desired standoff between the barrel and the medium; and electromechanical drive means for longitudinally moving said piston means, and with it said drawing pen device, such that said nib is brought into contact and out of contact with said medium; wherein said adjustable piston stop means includes plug means disposed in said barrel for blocking the stroke of said piston means, and setting means outside said barrel and coupled to the plug means through an elongated slot in the barrel, for setting the position of said plug means.

7. Drafting pen apparatus for stippling or drawing dotted or broken lines or the like on a sheet of drafting medium, comprising a barrel; piston means disposed within said barrel and longitudinally movable therein over a stroke length; a drawing pen device attached to said piston means and movable therewith having an ink reservoir and a pen nib extending out one end of said barrel for applying ink to said medium when the nib is in contact therewith; guide foot means adjustably mounted at said one end of the barrel for maintaining a desired standoff between the barrel and the medium; piezoelectric drive means bending under the influence of an applied electric voltage to urge said piston longitudinally, such that the drawing pen device moves with it and said nib is brought into contact and out of contact with said medium; and drive voltage supply means for applying a drive voltage to said piezoelectric drive means.

8. Drafting pen apparatus according to claim 7, further comprising adjustable piston stop means selectively settable for limiting the stroke length of said piston means.

9. Drafting pen apparatus according to claim 7, wherein said piezoelectric drive means includes a housing on said barrel, and an electrically bendable leaf within said housing affixed at one end to said housing and having a free end applying stroke motion to said piston.

10. Hand-held drafting pen apparatus for drawing interrupted lines, comprising a barrel; a technical pen slidably disposed within the barrel and including an ink reservoir and a pen nib extending from one end of the barrel for applying ink to a medium when the nib is in contact therewith; a guide foot adjustably mounted on said one end of said barrel and extending generally axially relative to the barrel for maintaining a desired standoff of said one end of the barrel from the surface of said medium; piston means attached to said technical pen and slidably disposed within the barrel; electrically powered drive means within said barrel for moving said piston relative to said barrel such that said technical pen nib is brought alternately into contact and out of contact with said medium; power supply means contained within said barrel supplying electrical drive power to said electrically powered drive means; and switch means disposed on said barrel for selectively actuating said drive means when interrupted lines are desired to be drawn.

11. Hand held drafting pen apparatus according to claim 10; wherein when said switch means is not actuated, said drive means acts to maintain said technical pen nib in a position extended distally from the barrel, so that the apparatus can then be used for drawing solid lines.

12. Drafting pen apparatus for stippling or drawing dotted or broken lines or the like on a sheet of drafting medium, comprising a barrel; piston means disposed within said barrel and longitudinally movable therein over a stroke length; a drawing pen device attached to said piston means and movable therewith having an ink reservoir and a pen nib extending out one end of said barrel for applying ink to said medium when the nib is in contact therewith; piezoelectric drive means bending under the influence of an applied electric voltage to urge said piston longitudinally, such that the drawing pen device moves with it and said nib is brought into contact and out of contact with said medium; and drive voltage supply means for applying drive voltage to said piezoelectric drive means.

13. Drafting pen apparatus according to claim 12, further comprising adjustable piston stop means selectively settable for limiting the stroke length of said piston means.

14. Drafting pen apparatus according to claim 13, wherein said piezoelectric drive means includes a housing on said barrel, and an electrically bendable leaf within said housing affixed at one end to said housing and having a free end applying stroke motion to said piston.

* * * * *